US008528150B1

(12) United States Patent
Mellott

(10) Patent No.: US 8,528,150 B1
(45) Date of Patent: Sep. 10, 2013

(54) FOOT OPERATED SCRUBBING DEVICE

(76) Inventor: Colin Brooks Mellott, Lebanon, PA (US)

( * ) Notice: Subject to any disclaimer, the term of this patent is extended or adjusted under 35 U.S.C. 154(b) by 116 days.

(21) Appl. No.: 13/183,503

(22) Filed: Jul. 15, 2011

Related U.S. Application Data

(60) Provisional application No. 61/366,308, filed on Jul. 21, 2010.

(51) Int. Cl.
*A47L 13/282* (2006.01)

(52) U.S. Cl.
USPC ..... 15/227; 15/229.11; 36/136; 451/523

(58) Field of Classification Search
USPC ..... 15/227, 229.11, 229.13; 36/113, 36/136; D32/40, 42, 50; 451/523
See application file for complete search history.

(56) References Cited

U.S. PATENT DOCUMENTS 5,075,984 A * 12/1991 Shiew ..... 36/113
5,173,985 A 12/1992 Palmer
5,613,897 A 3/1997 Thompson, Jr.
5,996,163 A 12/1999 Galizia
6,052,856 A 4/2000 DeMoya et al.
6,145,156 A 11/2000 Pullara, Jr. et al.
D461,030 S 7/2002 Cruell
6,430,771 B2 8/2002 Ahern
6,446,300 B1 9/2002 Sleezer
D546,011 S 7/2007 Favuzzi
7,814,605 B1 * 10/2010 Tippel ..... 15/114

OTHER PUBLICATIONS

MOP-AID SPOT Scrubbers, prior to Jul. 15, 2011.
Schmops Slippers That Clean!, prior to Jul. 15, 2011.
Walk 'n' Clean Mops Slippers, prior to Jul. 15, 2011.
SHUFFLES, prior to Jul. 15, 2011.
Savvy Bachelor Mop Slippers Accoutrements, prior to Jul. 15, 2011.
Mop Slippers, prior to Jul. 15, 2011.

* cited by examiner

*Primary Examiner* — Mark Spisich
(74) *Attorney, Agent, or Firm* — Hooker & Habib, P.C.

(57) ABSTRACT

A foot operated scrubbing device for scrubbing floors or other rigid surfaces is a rigid, U-shaped member that receives a user's foot. The foot presses against an upper surface of the U-shaped member to press an abrasive member against the floor. The upper surface of the U-shaped member has a textured surface that resists slipping of the foot along the upper surface of the member.

12 Claims, 4 Drawing Sheets

FOOT OPERATED SCRUBBING DEVICE

This application claims the benefit of U.S. Provisional Patent Application No. 61/366,308, filed on Jul. 21, 2010.

FIELD OF THE DISCLOSURE

Disclosed are devices for cleaning, particularly devices for cleaning floors, and related methods of cleaning.

BACKGROUND OF THE DISCLOSURE

Floors and similar walkway surfaces can be difficult to clean, particular when one has difficulty kneeling down on the floor to scrub and clean the floor.

To make it easier to clean the floor without kneeling, a number of floor scrubbing devices have been developed that strap onto or receive one's foot. Such floor scrubbing devices have an outer surface forming a mop or made of an abrasive member that contacts the floor and scrubs the floor.

Although such foot-adhering devices enable the floor to be scrubbed and cleaned without kneeling, they do have disadvantages.

Straps can be difficult to put on or remove from the foot, and have to be adjusted for the size of foot. Often the user must kneel in order to adjust the straps—thus defeating the "no kneeling" advantage supposedly offered by such devices.

Foot-adhering devices that utilize a slipper or other foot-receiving enclosure that extends around the entire foot can be difficult to put on or take off, and will accept only a limited range of foot sizes. Slipper-type floor scrubbers are also relatively expensive and are almost equivalent to a shoe when it comes to required storage space.

Thus there is a need for an improved scrubbing device that enables a user to scrub the floor without kneeling, does not have straps and is easy to put on and take off, takes up only a small amount of storage space, and is relatively inexpensive to manufacture.

SUMMARY OF THE DISCLOSURE

Disclosed is an improved foot operated scrubbing device that enables a user to scrub a floor without kneeling, does not have straps, and is easy to put on and take off. The scrubbing device takes up only a small amount of storage space and is relatively inexpensive to manufacture.

The foot operated scrubbing device in accordance with the present invention is a rigid, generally "U"-shaped member that receives a user's foot between the legs of the "U". The foot presses against an upper surface of the U-shaped member to press an abrasive member against the floor. The upper surface of the U-shaped member has a textured surface that resists slipping of the foot along the upper surface of the member.

The interface between the foot and the "U"-shaped member is the only source of force transferred to the abrasive member for moving the abrasive member against the floor. There is no need for straps, and no enclosures that surround the entire foot.

In preferred embodiments the "U"-shaped member is formed from injection molded plastic and so can be manufactured in high volumes at low cost. The abrasive member can be a separate member or can be permanently attached to the lower surface of the "U"-shaped member.

Other objects and features will become apparent as the description proceeds, especially when taken in conjunction with the accompanying four drawing sheets illustrating an embodiment of the scrubbing device.

DESCRIPTION OF THE PREFERRED EMBODIMENT

Figure 1:
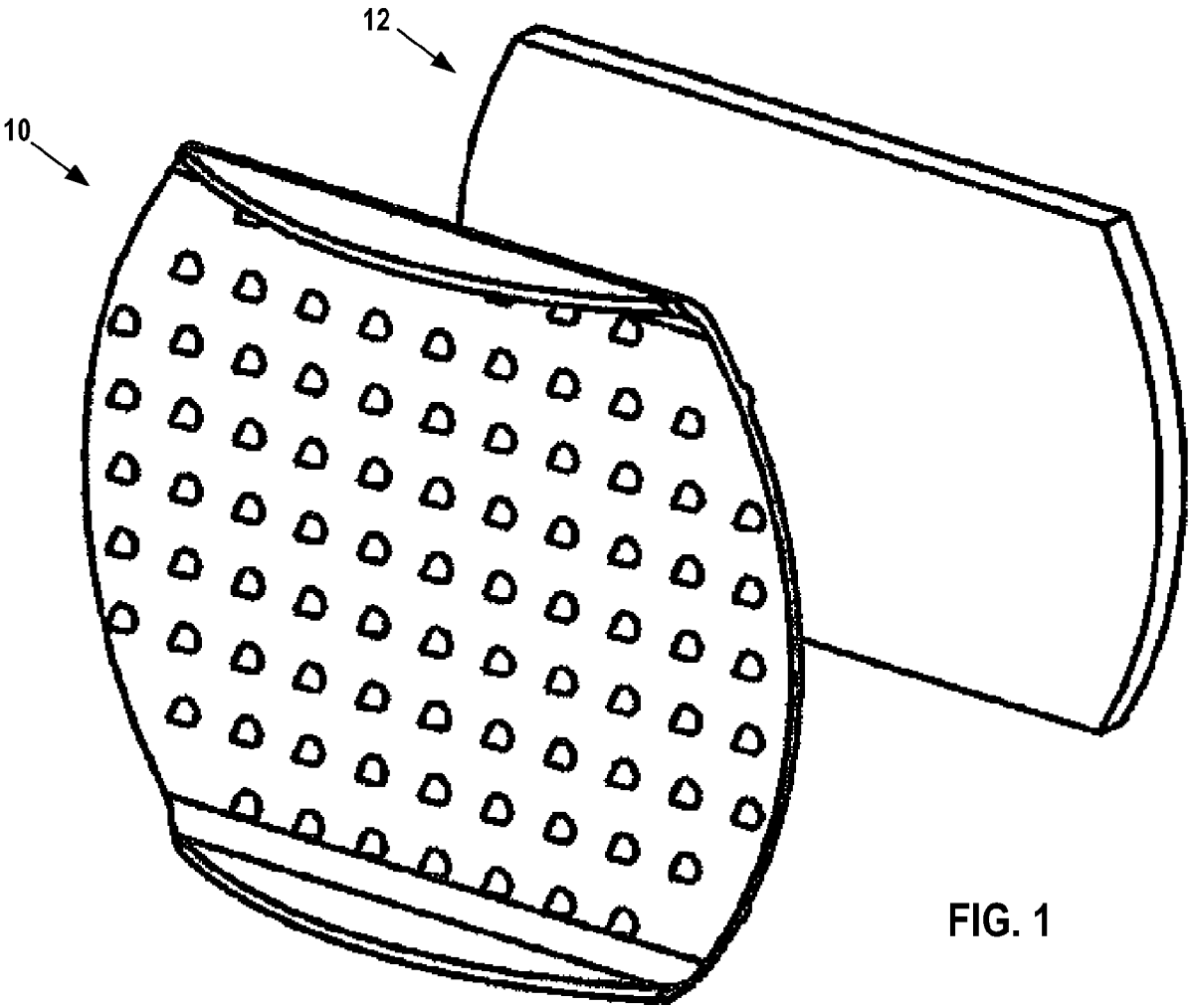
FIG. 1 is a perspective view of a foot operated scrubbing device and an abrasive member for use with the scrubbing device.

FIGS. 1-5 illustrates an embodiment of a foot operated floor scrubbing device 10. The device 10 is used to press and move an abrasive member 12 against a floor or other surface using one's foot as described in greater detail below.

The device 10 is formed as an integral, one-piece, substantially "U"-shaped plastic member, preferably manufactured by injection molding. The illustrated device 10 is approximately five inches wide, six inches long, and about one-tenth of an inch thick.

The plastic member 10 includes a generally rectangular plate or plate portion 14 and a pair of side members 16, 18 extending away from the plate 14. The plate 14 has convex, rounded ends 20, 22 separated by the length of the plate, and upper and lower sides 24, 26 respectively separated by the thickness of the plate.

The side members 16, 18 form the legs of the "U"-shaped member and are separated by the width of the plate 14. The side members 16, 18 each extend away from the upper side 24 and extend along the length dimension of the plate 14. Each side member 16, 18 has an inner face or planar surface 28 perpendicular to the plate 14, the surfaces 28 facing and parallel with one another.

The upper side 24 of the plate 14 is formed as a textured surface, with a number of pointed projections 30 spaced in linear rows and columns extending away from the upper side 24. The projections 30 can cover the entire side 24 as illustrated or may be limited to just between the side members 16, 18.

Figure 3:
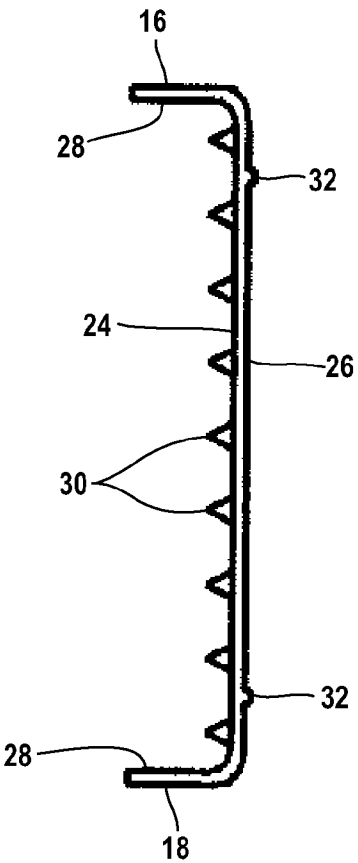
FIG. 3 is an end view of the scrubbing device shown in FIG. 1.
Figure 2:
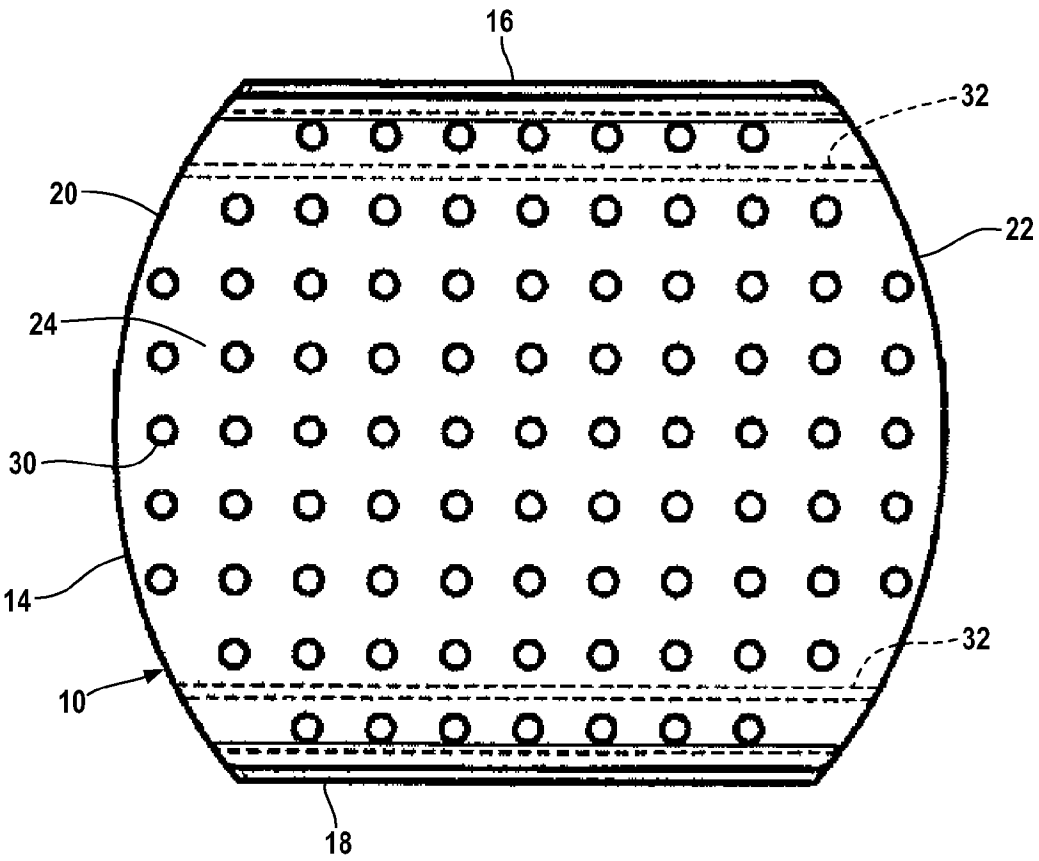
FIG. 2 is a top view of the scrubbing device shown in FIG. 1.
Figure 5:
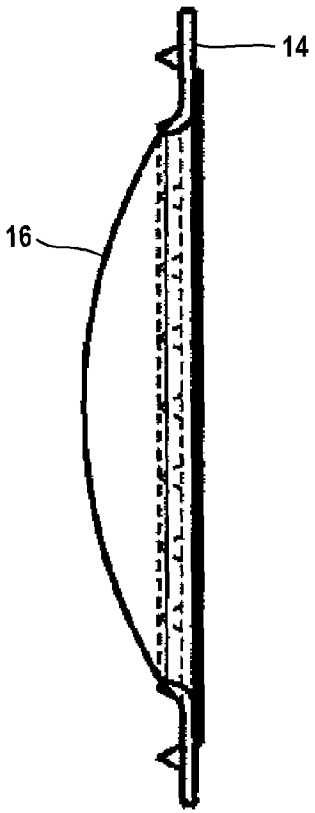
FIG. 5 is a side view of the scrubbing device shown in FIG. 1.
Figure 4:
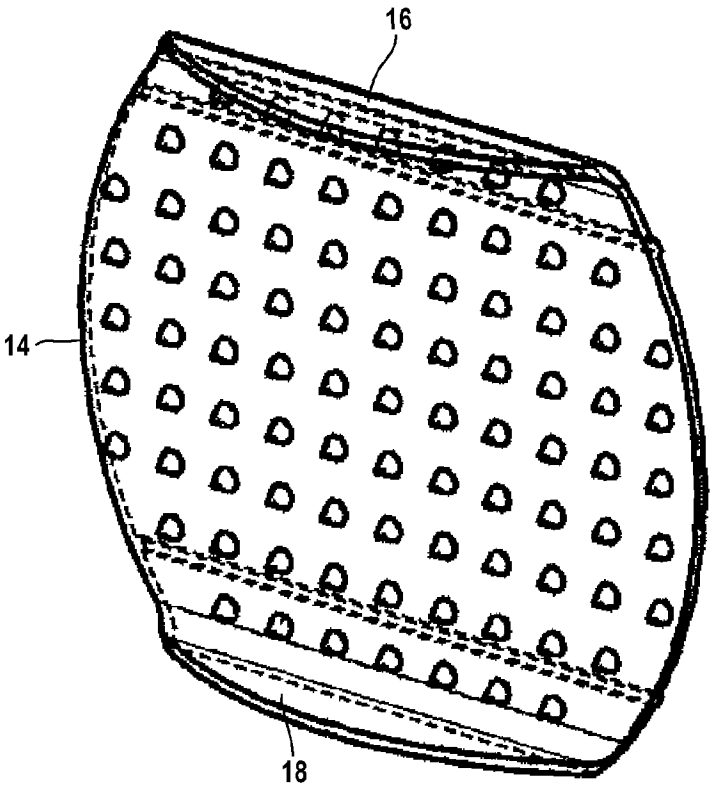
FIG. 4 is a perspective view similar to that shown in FIG. 1 but including hidden lines.

The lower side 26 of the plate 14 may be substantially flat, but the illustrated embodiment includes parallel projections or tabs 32 projecting from the lower side 26 and extending the length of the plate 32 as best seen in FIGS. 2 and 3. The tabs can fit in corresponding slots (not shown) in the abrasive member 12. Other patterns of cooperating tabs and slots can be used in other embodiments to assist in resisting relative movement between the plate 14 and the abrasive member 12 during use.

Use of the scrubbing device 10 to scrub a floor is described next.

Figure 6:
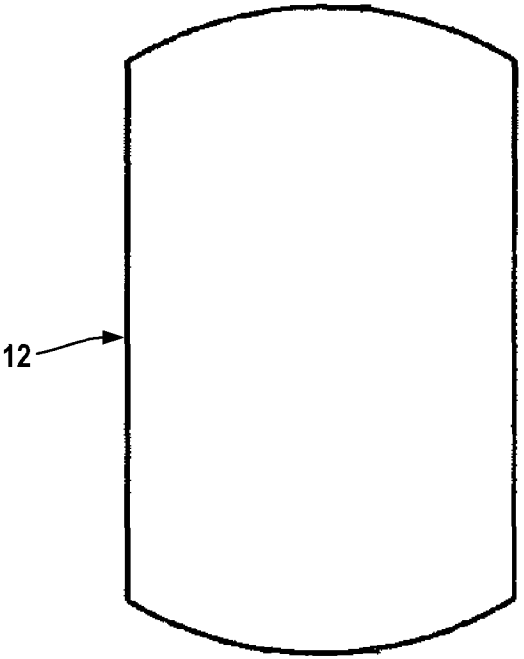
FIG. 6 is a top view of the abrasive member.

The abrasive 12 is placed on the floor. The device 10 is then placed over the abrasive member 12, the lower side 26 against the abrasive 12. As best seen in FIGS. 1 and 6, the outer periphery of the abrasive 12 is preferably shaped to conform to the outer periphery of the device 10.

In other possible embodiments, the abrasive member 12 is permanently attached to the lower side 26 of the member 10, and so placing the abrasive member 12 on the floor would automatically place the device 10 over the abrasive 12.

A user's foot is then inserted into the "U" shaped member 10, with the sides of the foot between the surfaces 28 of the side members 16, 18 and the foot pressing against the upper side 24 of the plate 14. The length of the member 10 is less than the length of most adult feet, and so the toes and/or heel of the foot would normally be located outwardly from the device 10.

The projections 30 provide a mechanical connection between the device 10 and the foot pressing against the device 10 that resists relative movement or slipping of the foot along the top plate side 24.

The user then moves his or her foot along the floor while the foot is engaged against the device 10 to move abrasive 12 relative to the floor for scrubbing the floor with the abrasive. The engagement of the foot with the device 10 is the only transfer of force between the foot and the device 10; it is not necessary for straps, slippers or any other auxiliary devices to be attached to the device 10 or to the user's foot when scrubbing the floor.

It is expected in commercial embodiments that different sizes of the device 10 may be manufactured for use by persons of differing foot sizes. Since the devices 10 are inexpensive and easy to store, users may wish to have multiple numbers of the devices 10 available for use and may wish to have devices 10 in different rooms of the house.

The abrasive member 12 can be formed from any of the abrasive or cleaning materials used for scrubbing or cleaning surfaces known to a person of ordinary skill in the cleaning arts. The abrasive member 12 would of course be compatible with the type of surface being cleaned and the material forming the device 10. Examples of such materials include, but are not limited to, cloth, chamois, sponge, microfibers, grit or lava particles, and the like.

The term "foot" as used herein is meant to include a user's foot whether barefoot or not barefoot.

While I have illustrated and described a preferred embodiment of my device invention, it is understood that this is capable of modification, and I therefore do not wish to be limited to the precise details set forth, but desire to avail myself of such changes and alterations as fall within the purview of the following claims.

What I claim as my invention is:

1. A foot operated scrubbing device comprising:

a plate having an upper side and an opposite lower side separated by a thickness of the plate, the plate including opposed first and second substantially curved ends and a pair of sides extending between the ends;

a pair of side members extending away from the upper side of the plate at the respective sides of the plate, the side members being substantially planar and parallel to each other, each of the side members having ends that stop adjacent the respective ends of the plate, the plate and the side members together defining a substantially U-shaped member;

the upper side of the plate including a textured surface comprised of a plurality of spaced-apart projections, the projections providing a secure engagement with a user's foot when placed on the upper side of the plate between the side members;

the lower side of the plate including a plurality of tabs projecting therefrom; and an abrasive scrubbing member, wherein the tabs on the lower side of the plate provide engagement between the plate and the scrubbing member as the scrubbing device is moved across a surface being cleaned.

2. The device of claim 1 wherein the plate and the side members are formed as a one-piece integral member.

3. The device of claim 2 wherein the integral member is formed from plastic.

4. The device of claim 1 wherein the plate, the side members, and the textured surface are formed as a one-piece integral member.

5. The device of claim 1 wherein the scrubbing member comprises at least one of the following (a)-(f): (a) cloth, (b) chamois, (c) sponge, (d) microfibers, (e) grit, (f) lava.

6. A foot operated scrubbing device comprising:

a plate having an upper side and an opposite lower side separated by a thickness of the plate, the plate including opposed first and second ends, and a pair of sides extending between the ends;

a pair of side members extending away from the upper side of the plate at the respective sides of the plate, each of the side members having ends that stop adjacent the respective ends of the plate, the plate and the side members together defining a substantially U-shaped member with the entire portion of the U-shaped member between the side members having a substantially uniform thickness;

a textured surface being on the upper side of the plate between the side members, the textured surface comprised of a plurality of spaced-apart projections, the projections providing a secure engagement with a user's foot when pressed against the textured surface between the side members;

a holder being on the lower side of the plate, the holder being disposed and configured to hold an abrasive scrubbing member and provide engagement between the plate and the scrubbing member when a scrubbing device held in the holder is moved across a surface being cleaned.

7. The foot operated scrubbing device of claim 6 wherein the holder comprises a pair of elongate tabs spaced apart from one another, each tab extending away from the lower side of the plate and configured to be received in corresponding grooves of a scrubbing member.

8. The foot operated scrubbing device of claim 7 further comprising a scrubbing member having a pair of grooves, each tab of the holder received in a respective groove.

9. The foot operated scrubbing device of claim 6 wherein the holder permanently affixes the scrubbing member to the plate.

10. The foot operated scrubbing device of claim 6 wherein the plate and the side members are formed as a one-piece integral member.

11. The device of claim 10 wherein the plate and side members are formed from plastic.

12. The device of claim 6 wherein the plate, the side members, and the textured surface are formed as a one-piece integral member.

* * * * *